United States Patent [19]

Smialowski et al.

[11] 4,261,595

[45] Apr. 14, 1981

[54] SKI BOOT HEEL LOCK

[76] Inventors: Antoni J. Smialowski, 29 Rothwell Dr., Ottawa, Ontario, Canada, K1J 7G5; Christopher Nowakowski, 120 Broadway, New York, N.Y. 10005

[21] Appl. No.: 889,005

[22] Filed: Mar. 22, 1978

[51] Int. Cl.[3] ..... A68C 9/00

[52] U.S. Cl. ..... 280/614; 280/623; 280/627; 280/631

[58] Field of Search ..... 280/614, 631, 632, 623, 280/626, 611, 627

[56] References Cited

U.S. PATENT DOCUMENTS

| | | | |
|---|---|---|---|
| 2,745,672 | 5/1956 | Meier | 280/627 |
| 2,991,086 | 7/1961 | Woodward | 280/623 |
| 3,186,727 | 6/1965 | Hatlapa | 280/626 |
| 3,908,971 | 9/1975 | Engel | 280/614 |
| 3,985,371 | 10/1976 | Pyzel et al. | 280/614 |

FOREIGN PATENT DOCUMENTS

| | | | |
|---|---|---|---|
| 172281 | 8/1952 | Austria | 280/631 |
| 1050579 | 3/1979 | Canada | 280/614 |
| 189433 | 5/1937 | Switzerland | 280/623 |
| 239029 | 12/1945 | Switzerland | 280/614 |

*Primary Examiner*—John J. Love
*Assistant Examiner*—Milton L. Smith
*Attorney, Agent, or Firm*—Lawrence I. Field

[57] ABSTRACT

A ski boot heel lock having a base secured to a ski and a lever secured to the base and having two extensions such that when one extension is moved towards the base, a bearing surface holds a ski boot heel against the ski and when the other extension is moved towards the base, the bearing surface releases the heel from the ski.

1 Claim, 10 Drawing Figures

SKI BOOT HEEL LOCK

This invention relates to a ski boot heel lock and specifically to a heel lock which can be used with cross-country or touring skis.

Cross-country skiing requires a binding to attach a ski boot to the ski which permits the heel of the boot to lift from the ski during use. Bindings which hold only the toe of the boot to the ski are satisfactory for most cross-country skiing, however there are downhill parts of ski trails upon which it would be much easier to travel if the ski boot heel were attached to the ski. This would permit greater control of the skis, and would also encourage safer skiing particularly for those people who partake of both downhill and cross-country skiing, as there is a strong tendency for a downhill skier to follow the downhill practice of leaning forward when cross-country skiing. Such a practice is disastrous with known cross-country bindings as the skier will topple forwards. The older type of bindings, such as a cable harness, held the toe of the boot onto the ski, and they could be arranged to hold down the heel of the boot onto the ski, however such an arrangement would require stopping on the trail and coupling the heel end of the cable onto hooks attached to the ski. Such coupling would have to be done by hand and would also create a hazard on a ski trail by having to stop on the trail.

There is therefore a requirement to have a cross-country binding which can be quickly operated while skiing to clamp and unclamp the heel of a boot onto a ski.

This invention relates to a ski boot heel lock which can be used in conjunction with cross-country bindings, the lock being operable during skiing to secure or free the heel of the boot. It is arranged so that it can be operated by the tips of the ski poles.

Generally, the invention in one of its embodiments consists of a base plate securable to a ski, a first lever pivotally secured to the rear end of the base plate, a second lever pivotally secured to the front end of the first lever, and a bell crank lever secured by one of its ends to the front end of the base plate and by the mid-point to the front end of the second lever. The other end of the bell crank lever has a bearing surface which can clamp the heel of the ski boot to a ski through a corresponding bearing surface on the heel. By having extensions, at the rear end of the first lever and the rear end of the second lever, and a tension spring between the rear end of the first lever and the front end of the second lever, the clamping of the front end of the bell crank lever to the heel can be achieved.

Various types of structure can be used to achieve the same purpose as that achieved by the referred to embodiment, and there can also be provided a safety release mechanism if required.

Figure 1:
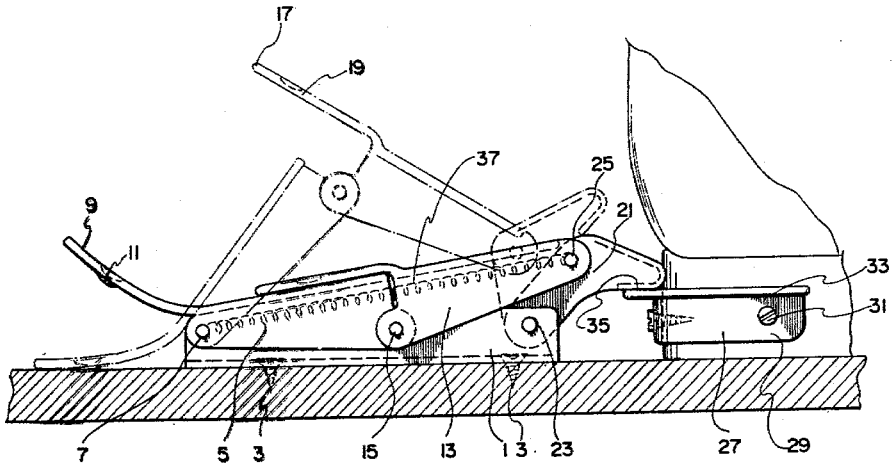
Figure 2:
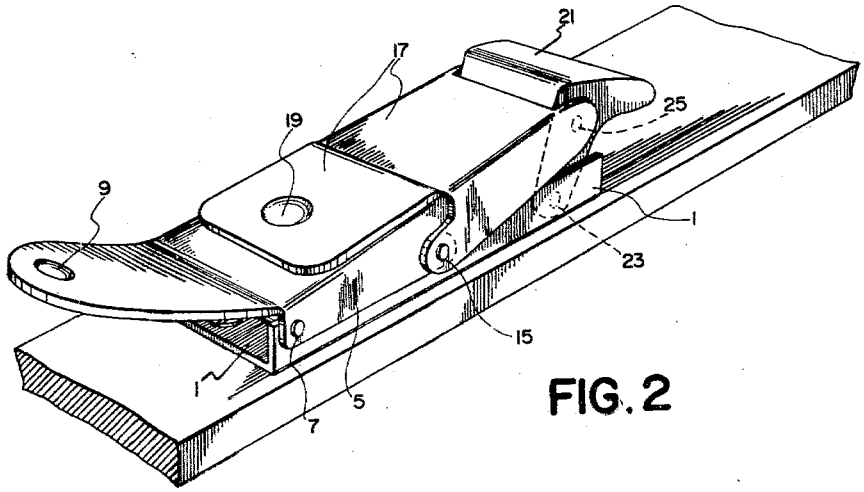
Figure 4:
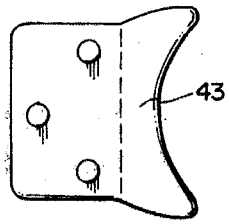
Figure 3:
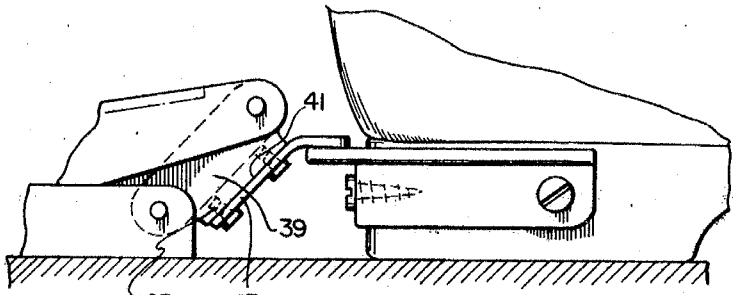
Figure 6:
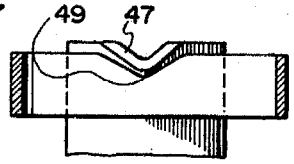
Figure 5:
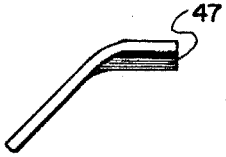
Figure 7:
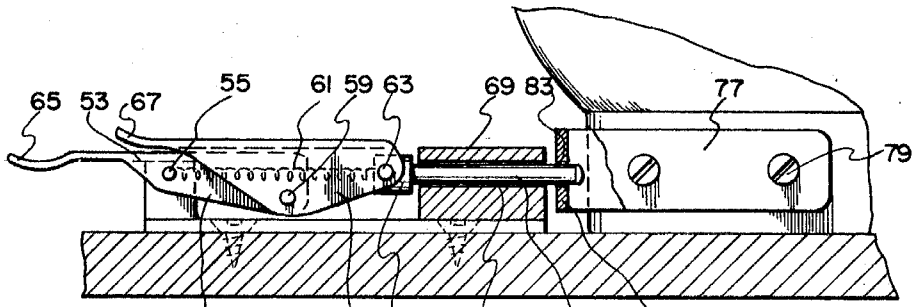
Figure 9:
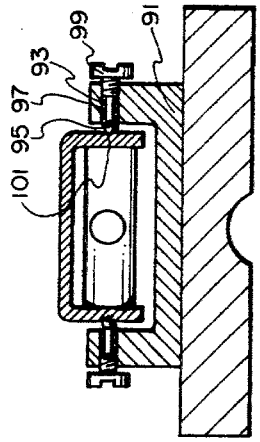
Figure 10:
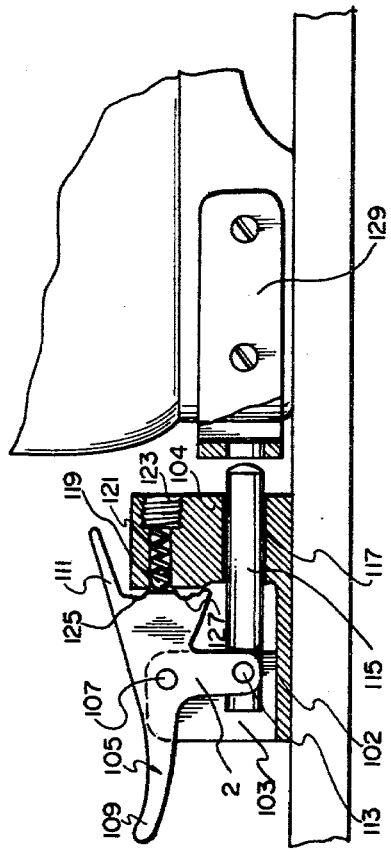
Figure 8:
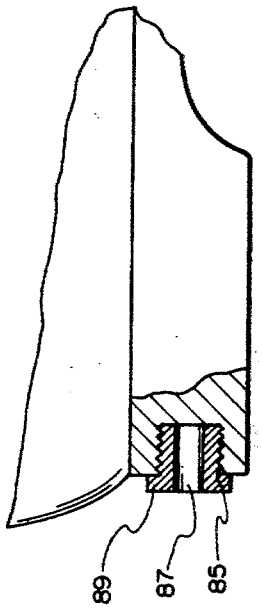

The invention will now be described with reference to the accompanying drawings in which:

FIG. 1 is a side elevational view of an embodiment of the apparatus of this invention showing part of a ski and ski boot, FIG. 2 is a perspective view of the apparatus of FIG. 1, FIG. 3 is a side elevational view of a modified clamping means, FIG. 4 is a plan view of part of the modified clamping means of FIG. 3, FIG. 5 is a side elevational view of another type of clamping means which can be used with the embodiment of FIG. 3, FIG. 6 is a front elevational view showing a heel element and the clamping means of FIG. 5, FIG. 7 is a further embodiment of the apparatus of this invention, FIG. 8 is a partial side elevational view of a ski boot heel showing a modified connector for use with the embodiment of FIG. 7, FIG. 9 is a front sectional elevational view showing a safety release mechanism, and FIG. 10 is a side elevational view, partly in section, of another embodiment of the apparatus of this invention.

Referring specifically to FIGS. 1 and 2 the heel lock is depicted secured to a ski, part of which is shown. The heel lock consists of a base 1 having holes for accommodating screws 3. A first lever 5 is pivotally secured to the rear end of the base 1, by a shaft 7. An extension 9 extends rearwardly past the shaft 7, this extension having a dimple 11 which can accommodate a ski pole tip.

A second lever 13 is pivotally secured at its rear end to the front end of the first lever 5, by a shaft 15. An extension 17 extends rearwardly of the axle 15 and has a dimple 19 for accommodating the tip of a ski pole.

A third bell crank lever 21 is pivotally secured to one end of the front end of the base 1 through an axle 23, and at its midpoint to the front end of the second lever 13 through axle 25.

The first, second and third levers all have a roughly U-shaped cross-section as shown in FIG. 2 and are conveniently made of sheet materials; however, it is obvious that any type of suitable construction could be utilized.

To be able to lock the heel of the ski boot to a ski, it is preferable to have a special attachment on the heel, and FIG. 1 shows such an attachment 27, which is a curved plate 29 secured by screws 31 and having a ridge 33 at its upper end which can be contacted by the front end of the lever 21 which is formed with a suitable bearing surface 35.

A coil spring 37 is stretched between axles 7 and 25, and, looking at FIG. 1, it will be seen that pressure applied to dimple 19 will force levers 5 and 13 to an overcenter substantially longitudinally aligned position and hence rotate bell crank lever 21 so that its bearing surface 35 pushes against ridge 33 on a ski boot heel. The spring 37 will hold levers 5 and 13 in the overcenter position. Pressure upon dimple 11 will rotate lever 5 in an anti-clockwise direction and the spring 37 will then assist in the movement and rotate bell crank lever 21 so that pressure is removed from the ridge 33 and the bearing surface 35 is withdrawn away from the heel. Extension 17 provides a stop for the relative movements of levers 5 and 13 when in an aligned position, and extension 9 provides a stop for the movement of lever 5 against the ski during the unlocked position thereby controlling the amount of rotation of the bell crank lever 21.

In FIGS. 3 and 4 there is shown an embodiment of the apparatus of FIG. 1, which utilizes, instead of bell crank 21, a lever 39 which has a bearing surface 41 to which can be connected a plate 43 by studs 45. By utilizing such an arrangement, it is possible to replace plate 43 to take into account wear of different types of attachments on ski boot heels.

In FIGS. 5 and 6, a further embodiment is shown in which the plate as shown in FIGS. 3 and 4 is modified to include a V-shaped ridge 47 which cooperates with a V-shaped groove 49 which is formed in the ski boot attachment. By utilizing such a structure, any transverse movement between the ski and heel is also limited as well as the vertical movement.

In the embodiment shown in FIG. 7, the heel lock consists of a base 51, a first lever 53 pivotally secured by its rear end to the base 51 through an axle 55; a second lever 57 pivotally secured to the front end of lever 53 by an axle 59, and a spring 61 between axle 55 and an axle 63 at the front end of the second lever. Both levers have extensions at their rearwardly facing ends which are respectively numbered 65 and 67 and they serve the same purpose as extensions 9 and 17 as discussed with reference to FIG. 1. At the front end of the base 51 there is provided a block 59 having a longitudinal centrally located bore 71 through which a rod 73 can slide. The rod 73 has an enlarged end 75 which is pivotally secured to the front end of the second lever through the axle 63. Alternatively, the enlarged part 75 can be formed with an integral axle 63 if desired.

The attachment to be fitted to a ski boot heel, in this instance, is of a U-shape having side portions 77 which are secured to a heel by screws 79, and a raised portion 81 having a hole 83 through which rod 73 can fit to locate the heel on a ski when required. The engagement and withdrawal of the rod 73 in hole 83 is controlled by pressing extension 75 to withdraw the rod and pressing extension 67 to engage the rod.

FIG. 8 shows an embodiment of an attachment to the heel of the ski boot which can be used as an alternative to the attachment shown in FIG. 7, and it consists of an externally threaded member 85 having a bore 87 and a flange 89 for use in inserting member 85 into a preformed hole in the heel. Bore 87 is sized to accommodate rod 73.

In FIG. 9 there is shown a means for pivoting the levers of the previous embodiments by utilizing a base 91 which has transverse threaded bores 93 into which are inserted a ball 95, a spring 97, and a stud 99. The levers are provided with dimples 101 for accommodating the balls 95, and by utilizing such a pivoting arrangment, a safety release mechanism is created such that if an excessive load is placed upon the lock mechanism when it is holding a heel in place upon a ski, the lock will separate and free the heel so avoiding injury to the skier. Obviously, other arrangements of a similar type could be utilized to provide a release mechanism, although due to the loose fitting of cross-country ski boots, which permit the foot to be withdrawn from the boot during an excessive pulling force, such release mechanism need only be utilized if extra injury protection is required.

In FIG. 10 there is shown a final embodiment of the lock of this invention which consists of a base 102 which has vertical extensions 103 and 104. A lever 105 of substantially T-shaped section is pivoted at its central region on an axle 107 which passes through vertical extension 103. Operation of the lever is accomplished through extensions 109 and 111. The lower end of the lever 105 is pivotally secured through axle 113 to a rod 115 which is positioned so that it can reciprocate in a bore 117 provided in the second extension 104. A positioning arrangement is provided by a ball 119 spring loaded by spring 121 held in place by stud 123 such that the ball 119 can engage in detent 125 or 127. A heel attachment 129 to cooperate with the rod 115 can be of the same form as that shown in FIGS. 7 or 8. To insert the rod 115 into the heel attachment, extension 109 is pressed to permit ball 119 to fall into detent 127, and to withdraw rod 115 from the heel attachment, extension 111 is pressed to permit ball 119 to fall into detent 125.

It will be seen that with any of the embodiments described above it will be relatively easy to secure or release a heel to or from a ski while the person is skiing merely by pushing the appropriate lever with a ski pole tip such that when sections of a cross-country trail are approached which require extra firm control of the skiis, the heel of the ski boot can be clamped temporarily to the ski until this seciton of trail has been transversed.

It is also be be understood that various modifications of this lock are envisaged within the scope of this invention which are only as limited by the following claims.

The embodiments of the invention in which an exclusive property of privilege is claimed and defined as follows:

1. In a ski boot heel lock having a base secured to a ski, a lever means secured to the base, the lever means being of a T-shape having two upper extensions and lower depending lever operatively connected to a reciprocably mounted rod, an upper and a lower detent in the lever means, and a projection from the base having a spring loaded ball therein selectively co-operable with the detent such that when one upper extension is moved towards the base, the reciprocably mounted rod is engaged with a ski boot heel and held in place by co-operation of the ball and one of the detents; and when the other of the upper extensions is moved towards the base, the reciprocably mounted rod is disengaged from the ski boot heel and held in place by co-operation of the ball and the other of the detents.

* * * * *